US009523930B2

(12) United States Patent
Kami et al.

(10) Patent No.: US 9,523,930 B2
(45) Date of Patent: Dec. 20, 2016

(54) PHOTOCONDUCTOR, AND IMAGE FORMING METHOD AND IMAGE FORMING APPARATUS USING THE SAME

(71) Applicants: Hidetoshi Kami, Shizuoka (JP); Nobutaka Eguchi, Kanagawa (JP); Akihiro Sugino, Shizuoka (JP); Keisuke Shimoyama, Shizuoka (JP); Kazuhiro Egawa, Shizuoka (JP)

(72) Inventors: Hidetoshi Kami, Shizuoka (JP); Nobutaka Eguchi, Kanagawa (JP); Akihiro Sugino, Shizuoka (JP); Keisuke Shimoyama, Shizuoka (JP); Kazuhiro Egawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/612,637

(22) Filed: Feb. 3, 2015

(65) Prior Publication Data

US 2015/0227063 A1 Aug. 13, 2015

(30) Foreign Application Priority Data

Feb. 12, 2014 (JP) ..... 2014-024585
Dec. 2, 2014 (JP) ..... 2014-243795

(51) Int. Cl.
*G03G 5/06* (2006.01)
*G03G 5/14* (2006.01)
*G03G 5/047* (2006.01)

(52) U.S. Cl.
CPC ..... *G03G 5/144* (2013.01); *G03G 5/047* (2013.01); *G03G 5/142* (2013.01)

(58) Field of Classification Search
CPC ..... G03G 5/104; G03G 5/144; G03G 5/0675; G03G 5/0696
See application file for complete search history.

(56) References Cited

U.S. PATENT DOCUMENTS 5,171,480 A * 12/1992 Yoshinaka ..... H01B 1/20 252/500
5,871,876 A 2/1999 Ikuno et al.
6,030,733 A 2/2000 Kami et al.
6,151,468 A 11/2000 Kami et al.
6,326,112 B1 12/2001 Tamura et al.
6,653,033 B1 11/2003 Kami et al.
(Continued)

FOREIGN PATENT DOCUMENTS

JP 2003-098705 4/2003
JP 2003-162080 6/2003
(Continued)

OTHER PUBLICATIONS

Machine English langauge translation of JP 2004037482, Feb. 5, 2004.*
U.S. Appl. No. 08/862,260, filed May 23, 1997.

*Primary Examiner* — Hoa V Le
(74) *Attorney, Agent, or Firm* — Oblon, McClelland, Maier & Neustadt, L.L.P.

(57) ABSTRACT

A photoconductor, including an electroconductive substrate; an intermediate layer overlying the electroconductive substrate; and a photosensitive layer overlying the intermediate layer. The intermediate layer includes a metal oxide and a binder resin, and has a WRa (LLH) less than 0.12 μm and WRa (LHH) of from 0.03 to 0.2 μm in a curve.

9 Claims, 7 Drawing Sheets

(56) References Cited

U.S. PATENT DOCUMENTS

2001/0044062 A1* 11/2001 Toshiyuki ..... G03G 5/005 430/60
2002/0018947 A1* 2/2002 Kabata ..... G03G 5/04 430/30
2002/0106570 A1 8/2002 Kami et al.
2002/0115005 A1 8/2002 Ikuno et al.
2002/0160287 A1* 10/2002 Miyamoto ..... G03G 5/04 430/56
2002/0173578 A1 11/2002 Suzuki et al.
2003/0016968 A1 1/2003 Takahashi et al.
2003/0026625 A1 2/2003 Tamiya et al.
2003/0035660 A1 2/2003 Sugino et al.
2003/0035661 A1 2/2003 Kabata et al.
2003/0059693 A1 3/2003 Ikegami et al.
2003/0073015 A1 4/2003 Tamoto et al.
2003/0077531 A1 4/2003 Suzuki et al.
2003/0113642 A1 6/2003 Kami et al.
2003/0118359 A1 6/2003 Ogiyama et al.
2003/0129511 A1* 7/2003 Kabata ..... G03G 5/04 430/56
2003/0129512 A1 7/2003 Sugino et al.
2003/0138711 A1* 7/2003 Kabata ..... G03G 5/04 430/56
2003/0194627 A1 10/2003 Ikegami et al.
2003/0215726 A1 11/2003 Sugino et al.
2003/0219279 A1 11/2003 Nohsho et al.
2004/0028435 A1 2/2004 Kurimoto et al.
2004/0048178 A1 3/2004 Ikuno et al.
2004/0105692 A1 6/2004 Tamiya et al.
2004/0126687 A1 7/2004 Ikegami et al.
2004/0126689 A1 7/2004 Tamoto et al.
2004/0185358 A1 9/2004 Kami
2004/0197687 A1 10/2004 Suzuki et al.
2004/0197688 A1 10/2004 Tamoto et al.
2004/0234294 A1 11/2004 Nagame et al.
2005/0008957 A1 1/2005 Ikegami et al.
2005/0026058 A1 2/2005 Kami et al.
2005/0031377 A1 2/2005 Kabata et al.
2005/0053853 A1 3/2005 Sugino et al.
2005/0079433 A1 4/2005 Watanabe et al.
2005/0100804 A1 5/2005 Tamoto et al.
2005/0105942 A1 5/2005 Kurimoto et al.
2005/0106482 A1 5/2005 Kami et al.
2005/0118518 A1 6/2005 Ikegami et al.
2005/0130050 A1 6/2005 Takada et al.
2005/0141919 A1 6/2005 Kitajima et al.
2005/0158644 A1 7/2005 Kondo et al.
2005/0170272 A1 8/2005 Suzuki et al.
2005/0181291 A1 8/2005 Kami et al.
2005/0201778 A1 9/2005 Takada et al.
2005/0255395 A1 11/2005 Suzuki et al.
2006/0056893 A1 3/2006 Kurimoto et al.
2006/0062595 A1 3/2006 Nousho et al.
2006/0127116 A1 6/2006 Ogiyama et al.
2006/0134540 A1* 6/2006 Kondo ..... C08G 69/50 430/59.5
2006/0141378 A1 6/2006 Takada et al.
2006/0199092 A1 9/2006 Sugino et al.
2006/0269323 A1 11/2006 Kabata et al.
2006/0286473 A1 12/2006 Kami
2007/0015074 A1 1/2007 Sugino et al.
2007/0031746 A1 2/2007 Toshine et al.
2007/0059039 A1 3/2007 Shimoyama et al.
2007/0059618 A1 3/2007 Kurimoto et al.
2007/0059619 A1 3/2007 Shimoyama et al.
2007/0117033 A1 5/2007 Sugino et al.
2007/0196749 A1 8/2007 Inaba et al.
2007/0196750 A1 8/2007 Fujiwara et al.
2007/0212626 A1 9/2007 Toshine et al.
2007/0248901 A1 10/2007 Shimoyama et al.
2007/0254224 A1 11/2007 Sugino
2007/0264047 A1 11/2007 Kurimoto et al.
2007/0287083 A1 12/2007 Gondoh et al.
2008/0085459 A1 4/2008 Kami et al.
2008/0112742 A1 5/2008 Nakamori et al.
2008/0113285 A1 5/2008 Nakamori et al.
2008/0113286 A1 5/2008 Shimoyama et al.
2008/0138725 A1 6/2008 Fujiwara et al.
2008/0138728 A1 6/2008 Sugino et al.
2008/0153021 A1 6/2008 Ikuno et al.
2008/0193865 A1 8/2008 Kondo et al.
2008/0199217 A1 8/2008 Iwamoto et al.
2008/0227008 A1 9/2008 Kami et al.
2008/0280221 A1 11/2008 Shimoyama et al.
2008/0305426 A1 12/2008 Kurimoto et al.
2008/0311499 A1 12/2008 Kami et al.
2008/0318142 A1 12/2008 Kawasaki et al.
2009/0067891 A1 3/2009 Kami et al.
2009/0068577 A1 3/2009 Ohta et al.
2009/0136260 A1 5/2009 Ikegami et al.
2009/0148180 A1 6/2009 Fujiwara et al.
2009/0180804 A1 7/2009 Kurimoto et al.
2009/0208246 A1 8/2009 Kami
2009/0311616 A1 12/2009 Shimoyama et al.
2010/0119260 A1 5/2010 Egawa et al.
2010/0124712 A1 5/2010 Egawa et al.
2010/0172670 A1 7/2010 Ohshima et al.
2010/0232831 A1 9/2010 Fujiwara et al.
2010/0233602 A1 9/2010 Yamamoto et al.
2010/0260513 A1 10/2010 Kawasaki et al.
2010/0260515 A1 10/2010 Shimoyama et al.
2010/0290807 A1 11/2010 Shimoyama et al.
2010/0316423 A1 12/2010 Kami et al.
2011/0020740 A1 1/2011 Sugino et al.
2011/0033203 A1 2/2011 Watanabe et al.
2011/0033791 A1* 2/2011 Tokutake ..... G03G 5/0696 430/59.5
2011/0076057 A1 3/2011 Kami et al.
2011/0111335 A1 5/2011 Shimoyama et al.
2011/0170884 A1 7/2011 Yamane et al.
2011/0183255 A1 7/2011 Kurimoto et al.
2011/0200924 A1 8/2011 Kami et al.
2011/0286777 A1 11/2011 Sugino et al.
2012/0008984 A1 1/2012 Kami et al.
2012/0088872 A1* 4/2012 Tong ..... G03G 5/102 524/169
2012/0163860 A1 6/2012 Shimoyama et al.
2012/0183313 A1 7/2012 Kurimoto et al.
2012/0225381 A1* 9/2012 Nakamura ..... G03G 5/144 430/131
2012/0237228 A1 9/2012 Kami
2013/0022902 A1 1/2013 Shimoyama et al.
2013/0059242 A1 3/2013 Asano et al.
2013/0059243 A1 3/2013 Hirose et al.
2013/0243483 A1 9/2013 Hirose et al.
2013/0243506 A1 9/2013 Ikuno et al.
2013/0244150 A1 9/2013 Toshine et al.
2013/0330104 A1 12/2013 Shimoyama et al.
2014/0064810 A1 3/2014 Iwamoto et al.
2014/0065530 A1* 3/2014 Nishida ..... G03G 5/0612 430/56
2014/0193185 A1 7/2014 Kami et al.
2014/0199620 A1 7/2014 Ishida et al.
2014/0212806 A1* 7/2014 Sugiyama ..... G03G 5/142 430/131
2014/0234763 A1 8/2014 Sugino et al.

FOREIGN PATENT DOCUMENTS

JP 2003-270808 9/2003
JP 2004-037482 2/2004
JP 2004037482 * 2/2004 ..... G03G 5/05
JP 2005-031433 2/2005
JP 2006-053577 2/2006
JP 2007-047467 2/2007
JP 2011-002480 1/2011
JP 2012-063720 3/2012

* cited by examiner

PHOTOCONDUCTOR, AND IMAGE FORMING METHOD AND IMAGE FORMING APPARATUS USING THE SAME

CROSS-REFERENCE TO RELATED APPLICATIONS

This patent application is based on and claims priority pursuant to 35 U.S.C. §119 to Japanese Patent Applications Nos. 2014-024585 and 2014-243795, filed on Feb. 12, 2014 and Dec. 2, 2014, respectively in the Japan Patent Office, the entire disclosure of which is hereby incorporated by reference herein.

BACKGROUND

1. Technical Field

The present invention relates to a photoconductor preventing background fouling well, and to an image forming method and an image forming apparatus using the photoconductor.

2. Description of the Related Art

Typically, image forming apparatuses such as printers, copiers and facsimiles using electrophotographic methods form images with a series of processes, i.e., charging, irradiating, developing, transferring and cleaning.

Means of performing such image formation include at least a charger, an image irradiator, an image developer (particularly a reverse image developer), a transferer, a cleaner and a photoconductor.

Such image forming apparatuses produce deteriorated images having grayish background when continuously used for long periods. When such images having background fouling are produced, the photoconductor is replaced with a new one.

Recently, print cost reduction and improvement of environmental performance have been demanded, and therefore photoconductors are required to have higher durability.

Constitutions or materials included in an intermediate layer between an electroconductive substrate and a photosensitive layer are changed, or an anodized film is formed on the surface of the electroconductive substrate as above to prevent holes from injecting into the photosensitive layer or a charge generation layer from the electroconductive substrate in reverse developing, which causes black spots. For examples, the following electrophotographic photoconductors are known:

(1) an electrophotographic photoconductor including an electroconductive substrate, and at least an undercoat layer formed of a resin including a heat-treated titanium oxide and a photosensitive layer thereon;

(2) an electrophotographic photoconductor including a substrate, and an undercoat layer including titanium oxide having an average primary particle diameter not greater than 0.4 μm and a thermosetting resin in a volume content of from 0.5 to 0.6 and a photosensitive layer thereon;

(3) an electrophotographic photoconductor for reverse developing, including an electroconductive substrate formed of aluminum or an aluminum alloy, and an anodized layer having surface peak intervals Sm of from 0.3 to 250 μm, a maximum height Rt of from 0.5 to 2.5 μm and a surface glossiness not less than 60 gloss, and a photosensitive layer thereon;

(4) an electrophotographic photoconductor including an electroconductive substrate, a photosensitive layer and an intermediate layer including a fine powder of titanium oxide on the surface of which zirconium oxide is present therebetween; and (5) an electrophotographic photoconductor including an electroconductive substrate, a photosensitive layer and an undercoat layer formed of a resin in which anatase-rutile mixed crystal titanium dioxide therebetween.

In order to improve background fouling, it is effective to form an intermediate layer on an electroconductive substrate of the photoconductor and a photosensitive layer thereon, which is a typical art. Various arts such as material constitutions and surface profiles of a photoconductor including an electroconductive substrate, and an undercoat layer and an intermediate layer overlying the substrate are disclosed to improve background fouling.

As a disclosure on the material constitutions, a photoconductor including an undercoat layer and an intermediate layer including a specific metal oxide such as titanium oxide is known.

Japanese Patent No. JP-4570155-B2 (Japanese published unexamined application NO. JP-2007-470467-A) discloses an electrophotographic photoconductor including an electroconductive substrate, and an undercoat layer, an intermediate layer and a photosensitive layer overlying the substrate this order. The undercoat layer two metal oxides having average particle diameters different from each other and a thermosetting resin, and the intermediate layer includes an organic metallic compound as a main component. This maintains good environmental stability and production of high-quality for long periods, and further prevents leak due to pin holes keeps good electrical properties even when used in a contact charger, and can be downsized.

Japanese Patent No. JP-3999074-B2 (Japanese published unexamined application NO. JP-2003-162080-A) discloses an electrophotographic photoconductor including an intermediate layer. The intermediate layer is formed by a coating liquid including an organic solvent, and a binder resin and titanium oxide dispersed therein. The titanium oxide has a specified average particle diameter to prepare a coating liquid having good coatability without defective coating and good stability. The resultant photoconductor produces high-quality images without defective images.

Japanese Patent No. JP-3878445-B2 (Japanese published unexamined application NO. JP-2003-98705-A) discloses an electrophotographic photoconductor including an electroconductive substrate, and an intermediate layer and a photosensitive layer thereon. The intermediate layer includes two titanium oxides and a binder resin, and a ratio of an average particle diameter of each of the two titanium oxides is specified for the electrophotographic photoconductor to produce high-quality images without defective images and have good durability.

Japanese published unexamined application NO. JP-2003-270808-A discloses a method of preparing an undercoat layer coating liquid for electrophotographic photoconductor, in which a particulate metal oxide and a binder resin are dispersed. From the beginning of dispersion process, a mixed solvent of a circular ketone solvent and a side-chain ketone solvent such as methyl ethyl ketone and cyclohexanone to dissolve a resin is added, and a metal oxide such as a titanium oxide or a surface-treated titanium oxide is wet pulverized. The undercoat layer coating liquid having good dispersibility, temporal stability, and coatability on an electroconductive substrate to form a uniform undercoat layer.

Japanese published unexamined application NO. JP-2004-037482-A discloses a method of producing an electrophotographic photoconductor including a substrate, and an undercoat layer and a photosensitive layer thereon. An undercoat layer coating liquid (a dispersion solvent is, e.g., methyl ethyl ketone and cyclohexanone) used for forming the undercoat layer by spray coating includes a metal oxide such as a titanium oxide or a surface-treated titanium oxide. The metal oxide has a specific sedimentation speed for preventing a spray nozzle, a filter and pipings from being clogged to improve productivity, and preventing coating defects such as uneven coating.

Meanwhile, modifying the surface profile is known as a method of improving background fouling.

Japanese published unexamined application NO. JP-2006-053577-A discloses a method of sampling a cross-sectional curve of an interface of a photosensitive layer at a substrate side in a horizontal direction and subjecting data of the height of the cross-sectional curve to a discrete Fourier conversion. Plural peaks in a specific area prove the photoconductor does not produce stripe-shaped images or light and shade stripe-shaped images, and an image forming apparatus using the photoconductor is capable of producing high-quality images.

Japanese published unexamined application NO. JP-2011-002480-A discloses a method of measuring a concave and convex shape of the surface of an electrophotographic photoconductor with a surface roughness/profile measurer to obtain a one-dimensional data array, subjecting the one-dimensional data array to a wavelet conversion and multi-resolution analysis to separate into six frequency components from high frequency to low frequency. Further, arithmetic mean roughness of total 12 frequency components including other six frequency components obtained by a specific method have specific relationships each other to improve acceptability of the electrophotographic photoconductor to a lubricant, prolong lives of the electrophotographic photoconductor and an image forming apparatus using the photoconductor, and reduce print cost.

Japanese published unexamined application NO. JP-2012-063720-A discloses a method of measuring a concave and convex shape of the surface of an electrophotographic photoconductor with a surface roughness/profile measurer to obtain a one-dimensional data array, subjecting the one-dimensional data array to a wavelet conversion and multi-resolution analysis to separate into six frequency components from high frequency to low frequency. Further, arithmetic mean roughness of total 12 frequency components including other six frequency components obtained by a specific method have specific relationships each other to provide just a required quantity of a lubricant to electrophotographic photoconductor when necessary, highly stabilize cleanability thereof, and high-quality images are produced thereby.

Japanese published unexamined application NO. JP-2005-031433-A discloses an electrophotographic photoconductor including an electroconductive substrate, and an undercoat layer and a photosensitive layer thereon, which is installed in an image forming apparatus using coherent light as an irradiating light to form an image. An arithmetic mean roughness and a maximum surface roughness of the surface of the undercoat layer, which are measured by a probe-type surface roughness meter are in specific ranges to produce uniform quality images without interference fringes and print defects such as black spots.

However, these conventional arts do not realize an intermediate layer producing higher quality images and having higher durability.

SUMMARY

Accordingly, one object of the present invention is to provide a photoconductor producing images without background fouling and having good durability.

Another object of the present invention is to provide an electrophotographic image forming method using the photoconductor.

A further object of the present invention is to provide an electrophotographic image forming apparatus using the photoconductor.

These objects and other objects of the present invention, either individually or collectively, have been satisfied by the discovery of a photoconductor, including an electroconductive substrate; an intermediate layer; and a photosensitive layer, wherein the intermediate layer comprises a metal oxide and a binder resin, and has a WRa (LLH) less than 0.12 μm and WRa (LHH) of from 0.03 to 0.2 μm in a curve obtained by (I) forming one-dimensional data array by measuring a concave-convex form of the surface of the intermediate layer by a surface roughness and profile measurer; (II) subjecting the one-dimensional data array to wavelet transformation by a multi-resolution analysis (MRA-1) to separate the data array into six frequency components through the highest frequency component HHH, the second frequency component HHL, the third frequency component HMH, the fourth frequency component HML, the fifth frequency component HLH to the lowest frequency component HLL; (III) thinning the one-dimensional data array of the minimum frequency component HLL so that a number of data array is reduced to 1/10 to 1/100 to prepare a thinned one-dimensional data array; (IV) subjecting the thinned one-dimensional data array to wavelet transformation by a multi-resolution analysis (MRA-2) to separate the data array into six frequency components through the highest frequency component HHH, the second frequency component HHL, the third frequency component HMH, the fourth frequency component HML, the fifth frequency component HLH to the lowest frequency component HLL; and (V) linking logarithms of eleven arithmetic mean roughnesses of from WRa (LLL) to WRa (HHH) excluding WRa (HLL) of the frequency components obtained in (II) and (IV), wherein the arithmetic mean roughnesses (Ra) of the frequency components are defined in JIS-B0601:2001 as follows:

WRa (HHH): Ra in a bandwidth having a cycle length of convexoconcave of from 0 to 3 μm, WRa (HHL): Ra in a bandwidth having a cycle length of convexoconcave of from 1 to 6 μm, WRa (HMH): Ra in a bandwidth having a cycle length of convexoconcave of from 2 to 13 μm, WRa (HML): Ra in a bandwidth having a cycle length of convexoconcave of from 4 to 25 μm, WRa (HLH): Ra in a bandwidth having a cycle length of convexoconcave of from 10 to 50 μm, WRa (HLL): Ra in a bandwidth having a cycle length of convexoconcave of from 24 μm to 99 μm, WRa (LHH): Ra in a bandwidth having a cycle length of convexoconcave of from 26 to 106 μm, WRa (LHL): Ra in a bandwidth having a cycle length of convexoconcave of from 53 to 183 μm, WRa (LMH): Ra in a bandwidth having a cycle length of convexoconcave of from 106 to 318 μm, WRa (LML): Ra in a bandwidth having a cycle length of convexoconcave of from 214 to 551 μm, WRa (LLH): Ra in a bandwidth having a cycle length of convexoconcave of from 431 to 954 μm, and WRa (LLL): Ra in a bandwidth having a cycle length of convexoconcave of from 867 to 1,654 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 11 is a schematic view illustrating an electrophotographic image forming apparatus using the electrophotographic process cartridge of the present invention.

DETAILED DESCRIPTION

Figure 1:
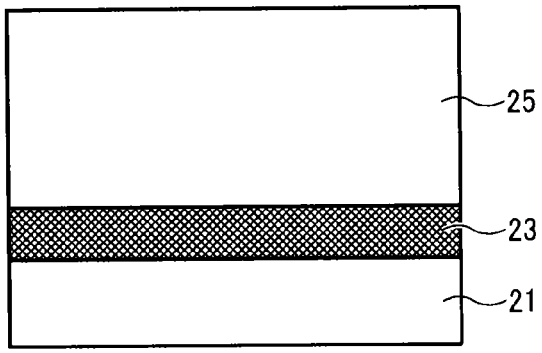
FIG. 1 is a cross-sectional view of a constitutional embodiment of the photoconductor of the present invention.

The present invention provides a photoconductor producing images without background fouling and having good durability.

An individual dot forming the background fouling has a diameter about 50 μm in many cases, and the size becomes larger as the background fouling becomes worse.

Charge leakage from the electroconductive substrate to the charged surface of a photoconductor is thought to cause the background fouling. Electrical potential convexities and concavities are thought to cause the charge leakage. The thickness of an intermediate layer directly influences on such potential convexities and concavities. Therefore, it is thought the convexities and concavities are advantageously flattened to prevent background fouling, above all, sharp points of the convexities and concavities forming background fouling are advantageously suppressed. However, when fine concave and convex cycles are flattened too much, the chargeability of a photoconductor lowers and a difference between the charge potential and the developing bias thereof narrows to cause foggy images. Its cause is not clear, but flattening the intermediate layer causes lowering of bulk resistance.

Even if the surface profile of the intermediate layer is simply flattened or roughened, the background fouling is not improved. Various surface profiles are formed using correlation between film formation and surface profile of the intermediate layer. Among various film forming methods, spray coating can be said an advantageous method of controlling the form of a film. The surface profile needs a precise analysis, and a multi-resolution analysis by wavelet conversion of a profile curve is effectively used. In the present invention, a surface profile looking half glossy is specified. In specific concave and convex cycles strongly influencing on the background fouling, the height thereof causing the background fouling is thought to have a threshold. Specifically, WRa (LHH) is preferably 0.2 μm or less. Its height is preferably 0.03 μm or higher to prevent foggy images. It is preferable the intermediate layer is macroscopically uniform to produce uniform images. From this reason, WRa (LLH) which can be said to represent undulation of the intermediate layer is preferably less than 0.12 μm.

The metal oxide preferably has an average primary particle diameter of from 0.18 to 0.22 μm in the present invention. When the metal oxide is fully dispersed, average roughness of individual center lines WRa calculated by dividing a profile curve of the surface profile of the intermediate layer with a wavelet conversion into each frequency band increases and decreases while correlations among WRa are held. The metal oxide is fully dispersed when 80% or more of fine particles thereof are dispersed in a coating liquid while not settling or a binder resin and metal oxide are distributed almost uniformly when the binder sin is observed.

The average primary particle diameter of a filler is measured by directly observing fine particles thereof dispersed in a reagent or a coating film with a scanning electron microscope or a confocal microscope. An image analysis software represented by image J published by US NIH is preferably used to calculate the average particle diameter.

The metal oxide preferably has an average particle diameter larger than 0.05 μm and smaller than 0.10 μm to for the surface profile of the present invention. At present, titanium oxide as the inexpensive metal oxide do not always satisfy the size specified in the present invention. Therefore, plural metal oxides are preferably mixed to use. When metal oxides having different particle sizes, spaces formed among large metal oxides are filled with small metal oxides, and concealment of the metal oxides in a coating liquid improves. This is thought to prevent the background fouling. In addition, the metal oxides having different particle sizes are advantageously used to precisely control the shape of the intermediate layer.

The intermediate layer preferably has a thickness of from 4 to 7 μm to easily form the surface profile to prevent background fouling and dry in a short time for saving production cost. Further, the intermediate layer having thickness of from 4 to 7 μm prevents background fouling and residual potential, improves chargeability of a photoconductor, and has less restrictions when used in an image forming apparatus.

A photosensitive layer having a specific surface profile prevents background fouling for long periods. Particularly, a combination with the intermediate layer exerts a synergistic effect. This is because images having background fouling are produced due to different configurations even an intermediate layer excellently preventing background fouling is used. The surface profile of a photosensitive layer influences on tribological characteristics with a member contacting a photoconductor. Specifically, wettability (adhesiveness)

with a developer and shearing stress with a compression stress with a cleaning blade typically formed of a rubber plate vary according to the surface profile of a photosensitive layer.

These good tribological characteristics make the intermediate layer of the present invention fully resist the background fouling. Particularly, WRa (LLH) obtained by MRA-1 and MRA-2 is preferably from 0.07 to 0.2 μm.

Particularly, a combination of the photosensitive layer having WRa (LLH) less than 0.12 μm and the intermediate layer having WRa (LLH) of from 0.03 to 0.2 μm synergistically prevents background fouling.

When less than 0.07 μm, blade abrasion is accelerated, resulting in production of images having background fouling before long. When greater than 0.2 μm, a toner scrapes off from a cleaner and contaminates images. The surface profile cannot be formed by the most typical dip coating method of preparing an organic photoconductor. WRa (LLH) formed by the dip coating method is about 0.02 μm. A surface protection layer having a thickness less than 10 μm is formed by a spray coating method of spraying a coating liquid having low viscosity, and WRa (LLH) rarely exceeds 0.05 μm. The surface profile is formed by repeatedly coating a coating liquid having a viscosity not less than 10 mPas while properly dried.

The photoconductor preferably includes cyclohexanone in an amount of from 10 to 100 ppm.

The intermediate layer having a specific surface profile of the present invention is formed by repeatedly coating a coating liquid while properly dried. Cyclohexanone is preferably mixed in the coating liquid to form the surface profile. A boiling point and a viscosity thereof are thought to work. In addition, the intermediate layer including cyclohexanone in an amount of from 100 to 1,000 pp improves durability of the photoconductor with the surface profiles of the photoconductor and the photosensitive layer.

The image forming method and the image forming apparatus using the specific photoconductor of the present invention have lives not less than 5 times longer than those of the present method and apparatus. This is achieved by the new shape effect of an intermediate layer or a photosensitive layer found in the present invention.

FIG. 1 is a cross-sectional view of a constitutional embodiment of the photoconductor of the present invention, in which at least an intermediate layer including metal oxide (23) and a photosensitive layer (25) are layered on an electroconductive substrate (21).

Figure 2:
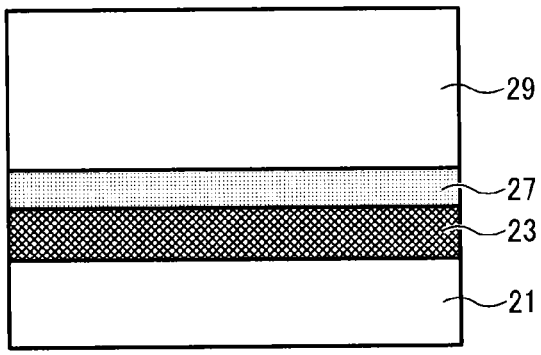
FIG. 2 is a cross-sectional view of another constitutional embodiment of the photoconductor of the present invention.

FIG. 2 is a cross-sectional view of another constitutional embodiment of the photoconductor of the present invention, in which at least an intermediate layer including metal oxide (23), a charge generation layer (27) and a charge transport layer (29) are layered on an electroconductive substrate (21).

Figure 3:
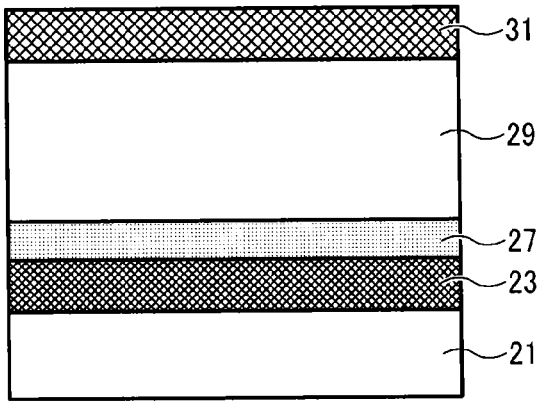
FIG. 3 is a cross-sectional view of a further constitutional embodiment of the photoconductor of the present invention.

FIG. 3 is a cross-sectional view of a further constitutional embodiment of the photoconductor of the present invention, in which a protection layer (31) is further formed on the charge transport layer (29) in FIG. 2.

As the electroconductive substrate (21), an electroconductive substrate having a volume resistance of not greater than $10\times10^{10}\Omega\cdot$cm such as plastic or paper having a film-like form or cylindrical form covered with a metal such as aluminum, nickel, chrome, nichrome, copper, gold, silver, and platinum, or a metal oxide such as tin oxide and indium oxide by depositing or sputtering, or a board formed of aluminum, an aluminum alloy, nickel, and a stainless metal can be used and a tube which is manufactured from the board mentioned above by a crafting technique such as extruding and extracting and surface-treatment such as cutting, super finishing, and grinding can be used. The aluminium alloys are formed by the method disclosed in JIS3003, 5000, 6000, etc. and the non-cut aluminum tube is formed by a conventional method such as EI, ED, DI and II methods. In addition, a surface cut process and grind with a diamond turning tool, etc. or a surface treatment such as anodizing is performed on the aluminium tube.

Further, endless belts of a metal such as nickel and stainless steel, which have been disclosed in Japanese published unexamined application No. JP-S52-36016-A can also be used as the electroconductive substrate (21).

As mentioned above, the non-cut aluminum tube is occasionally used to reduce cost of the electroconductive substrate. As the non-cut aluminum tube, DI tube formed by subjecting an aluminum disc to deep drawing to have the shape of a cup and the outer surface to ironing, II tube formed by subjecting an aluminum disc to impact processing to have the shape of a cup and the outer surface to ironing, EI tube formed by subjecting the outer surface of an aluminum drawn tube to ironing and ED tube formed by subjecting an aluminum disc to extrusion and cold drawing disclosed in Japanese published unexamined application No. JP-H03-192265-A are known. These non-cut aluminum tubes tend to produce abnormal images such as moiré. However, the photoconductor of the present invention produces high-quality images without producing abnormal images such as moiré and has good durability even formed of the non-cut aluminum tube.

In addition, an electroconductive substrate formed by coating a liquid in which electroconductive powder is dispersed in a suitable binder resin on a substrate made from plastic can also be used as the electroconductive substrate (21).

Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resin used simultaneously include, but are not limited to, thermoplastic resins, thermosetting resins or photocurable resins such as polystyrene resins, copolymers of styrene and acrylonitrile, copolymers of styrene and butadiene, copolymers of styrene and maleic anhydrate, polyesters resins, polyvinyl chloride resins, copolymers of a vinyl chloride and a vinyl acetate, polyvinyl acetate resins, polyvinylidene chloride resins, polyarylate resins, phenoxy resins, polycarbonate reins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenolic resins, and alkyd resins.

Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

Further, an electroconductive substrate formed by providing a heat contraction tube as an electroconductive layer on a suitable cylindrical substrate can also be used as the electroconductive substrate (21) in the present invention. The heat contraction tube is formed of materials such as polyvinyl chloride, polypropylene, polyester, polystyrene, polyvinylidene chloride, polyethylene, chloride rubber, and polytetrafluoroethylene fluororesins, which includes the electroconductive powder mentioned above.

The intermediate layer (23) mainly includes a metal oxide and a resin. Considering that a photosensitive layer is applied to the intermediate layer in a form of solvent, the resin is preferably hardly soluble in a known organic solvent. Specific examples of such resins include, but are not limited to, water-soluble resins such as polyvinyl alcohol, casein and sodium polyacrylate, alcohol-soluble resins such as copolymerized nylon, and methoxymethylated nylon, curing resins forming three-dimensional structure such as polyurethane, melamine resins, alkyd-melamine resins and epoxy resins.

A weight ratio of the metal oxide to the resin is preferably from 3/1 to 8/1.

When less than 3/1, carrier transportability of the intermediate layer lowers to cause residual potential or lowers photoresponsivity.

When not less than 8/1, spaces in the intermediate layer increase and air bubbles are formed therein when a photosensitive layer is formed thereon.

The metal oxide can be prepared by a sulfuric acid method or a chlorine method, and the chlorine method is preferably used to prepare metal oxide having high purity.

The chlorine method includes chlorinating titanium slug with chlorine to form titanium tetrachloride; separating, condensing, refining and oxidizing the titanium tetrachloride to form crude metal oxide; crushing, classifying, applying a surface treatment to when necessary, filtering, washing, drying and pulverizing the crude metal oxide to prepare metal oxide.

The particle diameter of the titanium oxide can be controlled by controlling the primary particle diameter thereof.

In the present invention, metal oxides having different average primary particle diameters are used to improve concealment of an electroconductive substrate, which prevents moiré and decreases pin holes causing abnormal images.

Therefore, it is essential two metal oxides have a constant particle diameter ratio in a specific range. When the average primary particle diameter is too small, the metal oxide increases in surface activation and the electrostatic stability of the resultant photoconductor is impaired. When too large, concealment of the electroconductive substrate lowers, resulting in deterioration of preventing moiré and decreases pin holes causing abnormal images.

The purity of the metal oxide can be controlled by purity of materials or surface treatment, and particularly the chlorine method can obtain metal oxide having high purity.

The metal oxide preferably has a purity not less than 99.0%.

Impurities thereof are mostly hygroscopic and ionic materials such as Na2O and K2O. When the purity is less than 99.0%, properties of the resultant photoconductor largely change due to the environment (particularly to the humidity) and repeated use.

Further, the impurities tend to cause defective images such as black spots.

The purity of the metal oxide can be determined by a measurement method specified in JIS K5116.

The metal oxide preferably has a rutilated rate of from 10 to 60%.

Typically, the metal oxide has two crystal forms, i.e., anatase and rutile, and they affect specific gravity, refractive index, and hardness of the metal oxide.

The crystal form depends on sintering conditions when preparing metal oxide. Mild conditions form an anatase crystal and a rutile crystal is formed as sintering temperature increases. Therefore, the sintering temperature is controlled to control the rutilated rate.

The reason why the rutilated rate of from 10 to 60% is preferable is not clarified, but which improves background fouling. The metal oxide more preferably has a rutilated rate of from 30 to 60%.

The rutilated rate can be measured by an intensity of an interference line caused by each crystal form in a powder X-ray diffraction.

When a mixing ratio of two metal oxides having different average primary particle diameters is less than 0.2, abnormal images such as black spots and background fouling are less prevented. When greater than 0.8, light scatters less in the intermediate layer to cause moiré.

The intermediate layer (23) is formed by coating a coating liquid including a suitable solvent, a metal oxide and a binder resin as mentioned above.

The intermediate layer (23) preferably has a thickness of from 1.0 to 10 μm, and more preferably from 4.0 to 7.0 μm.

The charge generation layer (27) includes at least a charge generation material and a binder resin when necessary.

Specific examples of the binder resin include, but are not limited to, polyamide, polyurethane, epoxy resins, polyketone, polycarbonate, polyarylate, silicone resins, acrylic resins, polyvinyl butyral resins, polyvinyl formal resins, polyvinyl ketone, polystyrene, poly-N-vinylcarbazole, polyacrylamide, polyvinylbenzal, polyester, phenoxy resins, vinylchloride-vinylacetate copolymers, polyvinylacetate, polyphenyleneoxide, polyvinylpyridine, cellulose resins, casein, polyvinylalcohol and polyvinylpyrrolidone.

The charge generation layer preferably includes the binder resin in an amount of from 0 to 500 parts by weight, and more preferably from 10 to 300 parts by weight per 100 parts by weight of the charge generation material.

Specific examples of the charge generation material include, but are not limited to, phthalocyanine pigments such as metal phthalocyanine and metal-free phthalocyanine; azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments; and azo pigments such as monoazo pigments, bisazo pigments, asymmetric disazo pigments, trisazo pigments and tetraazo pigments.

The charge generation layer (27) is formed by dispersing at least a charge generation material and a binder resin when necessary in a solvent using a ball mill, an attritor, a sand mill or an ultrasonic to prepare a coating liquid, and applying and drying the coating liquid on the intermediate layer (23). Specific examples of the solvents include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroin.

Specific examples of methods of coating a coating liquid include, but are not limited to, dip coating methods, spray coating methods, bead coating methods, nozzle coating methods, spinner coating methods and ring coating methods.

The charge generation layer (27) typically has a thickness of from 0.01 to 5 μm, and preferably from 0.1 to 2 μm.

The charge transport layer (29) includes a charge transport material as a main component, and is formed by dispersing a charge transport material and a binder resin in a solvent such as tetrahydrofuran, dioxane, dioxolane, anisole, toluene, monochlorbenzene, dichlorethane, methylene chloride and cyclohexanone, and applying and drying the solution or the dispersion on the charge generation layer (27).

The charge transport material includes a positive hole transport material and an electron transport materials.

Specific examples of the electron transport materials include known electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, 3,5-dimethyl-3',5'-ditertiarybutyl-4,4'-diphenoquinone and benzoquinone derivatives. These electron transport materials can be used alone or in combination.

Specific examples of the positive hole transport materials include, but are not limited to, electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, thiazole derivatives, triazole derivatives, phenazine derivatives, acridine derivatives, benzofuran derivatives, benzimidazole derivatives and thiophene derivatives. These positive hole transport materials can be used alone or in combination.

Specific examples of the binder resin for use in the charge transport layer include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the polycarbonate copolymers disclosed in Japanese published unexamined applications Nos. JP-H05-158250-A and JP-H06-51544-A.

In addition, a charge transport polymer material having functions of a binder resin and a charge transport material can be used as the binder resin. The charge transport polymer materials have the following constitutions:

(a) polymers having a carbazole ring include poly-N-vinyl carbazole, and compounds disclosed in Japanese published unexamined applications Nos. JP-S50-82056-A, JP-S54-9632-A, JP-S54-11737-A and JP-H04-183719-A;

(b) polymers having a hydrazone skeleton include compounds disclosed in Japanese published unexamined applications Nos. JP-S57-78402-A and JP-H03-50555-A;

(c) polysilylene compounds include compounds disclosed in Japanese published unexamined applications Nos. JP-S63-285552-A, JP-H05-19497-A and JP-H05-70595-A; and (d) polymers having a triaryl amine skeleton include N,N-bis(4-methylphenyl)-4-aminopolystyrene, and compounds disclosed in Japanese published unexamined applications Nos. JP-H01-13061-A, JP-H01-19049-A, JP-H01-1728-A, JP-H01-105260-A, JP-H02-167335-A, JP-H05-66598-A and JP-H05-40350-A.

The charge transport layer preferably includes a binder resin of from 0 to 200 parts by weight per 100 parts by weight of the charge transport material.

The charge transport layer may include a plasticizer, a leveling agent and an antioxidant when necessary.

Specific examples of the plasticizer include halogenated paraffin, dimethyl naphthalene, dibutylphthalate, dioctylphthalate, tricresyl phosphate, polymer and copolymers of polyester, etc.

The charge transport layer preferably includes the plasticizer in an amount of from 0 to 30 parts by weight per 100 parts by weight of the binder resin.

Specific examples of the leveling agent include silicone oils such as dimethylsilicone oil and methylphenyl silicone oil; and a polymer or an oligomer having an alkyl group on the side chain. The charge transport layer preferably includes the leveling agent in an amount of from 0 to 1 part by weight per 100 parts by weight of the binder resin.

The charge transport layer may include an antioxidant to improve environmental resistance, i.e., against oxidizing gas such as ozone and NOx. The antioxidant may be added to any layers including an organic material, and preferably added to a layer including a charge transport material.

Specific examples of the antioxidant include, but are not limited to, hindered phenol compounds, sulfuric compounds, phosphate compounds, hindered amine compounds, pyridine derivatives, a piperidine derivatives and morpholine derivatives. The charge transport layer preferably includes the antioxidant in an amount of from 0 to 5 part by weight per 100 parts by weight of the binder resin.

The charge transport layer preferably has a thickness of from 5 to 50 μm, more preferably from 20 to 40 μm, and furthermore preferably from 25 to 35 μm.

The photosensitive layer (25) of a single-layered photoconductor (25) includes a charge generation material, a dispersant, a charge transport material and a binder resin. The above-mentioned charge generation materials and the charge transport materials can be used.

The single-layered photosensitive layer is formed by dissolving or dispersing a charge generation material, a charge transport material, a dispersant and a binder resin in a solvent such as tetrahydrofuran, cyclohexanone, dioxane, dichloroethane and butanone with a ball mill, an attritor or a sand mill to prepare a solution or a dispersion, and applying and drying the solution or the dispersion. The solution or the dispersion are applied by a dip coating method, a spray coating method, a roll coating method or a blade coating method.

As the binder resin, the binder resin used in the charge transport material can be used, and may be combined with the resin used in the charge generation material.

In addition, a single-layered photosensitive layer including a eutectic complex formed of a pyrylium dye and bisphenol A polycarbonate, and a charge transport material can be prepared by the above-mentioned method.

Further, the single-layered photosensitive layer may include a plasticizer, a leveling agent, an antioxidant, etc.

The single-layered photosensitive layer preferably has a thickness of form 5 to 50 μm.

The protection layer (31) is formed to improve durability of the photoconductor.

Suitable materials for use in the protection layer include ABS resins, ACS resins, olefin-vinyl monomer copolymers, chlorinated polyethers, aryl resins, phenolic resins, polyacetal, polyamides, polyester resins, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, polyester, etc.

The protection layer (31) may include an inorganic material such as fluororesins, e.g., polytetrafluoroethylene, silicone resins, metal oxide, aluminum oxide, tin oxide, zinc oxide, magnesium oxide, silica and their surface-treated materials, and further s charge transport material.

The protection layer (31) is formed by a conventional coating method. The protection layer (31) preferably has a thickness of from 0.1 to 10 μm.

In addition, a protection layer formed by a vacuum thin film forming method using known materials such as a-C and a-SiC can be used.

In the present invention, another intermediate layer (unillustrated) can be formed between the photosensitive layer (25) and the protection layer (31). The intermediate layer includes a resin as a main component. Specific examples thereof include polyamide, alcohol-soluble nylon resins, hydrosoluble butyral resins, polyvinylbutyral and polyvinylalcohol. The intermediate layer can be formed by the conventional coating methods, and preferably has a thickness of from 0.05 to 2 μm.

Hereinafter, the multi-resolution analysis of a profile curve of an electrophotographic photoconductor will be described.

In this analysis, initially a profile curve (described in JIS B0601) of a photoconductor is obtained, wherein the profile curve is a one-dimensional data array. The one-dimensional data array can be obtained from digital signals output from a surface roughness/profile measuring instrument. Alternatively, it is possible to subject analogue output from a surface roughness/profile measuring instrument to analogue-digital conversion.

The length of a measurement portion of the photoconductor (measurement length) is preferably the length described in JIS B0601, and is a length of from 8 mm to 25 mm. In addition, the sampling interval is preferably not greater than 1 μm, and more preferably from 0.2 μm to 0.5 μm. For example, it is preferable that the measurement length is 12 mm, and the number of measurement points is 30720, wherein the sampling interval is 0.390625 μm.

This one-dimensional data array is subjected to wavelet transformation (MRA-1) to perform a multi-resolution analysis, i.e., to separate the one-dimensional data array to plural frequency components of from a high frequency component (HHH) to a low frequency component (LLL) (for example, six components (HHH), (HHL), (HMH), (HML), (HLH) and (HLL)). In addition, a one-dimensional data array is prepared by thinning the one-dimensional data array of the minimum frequency component (HLL) so that the number of data array is reduced to 1/10 to 1/100. The thus obtained one-dimensional data array is subjected to wavelet transformation (MRA-2) to perform a multi-resolution analysis, i.e., to separate the data into six frequency components of from a high frequency component to a low frequent component (i.e., LHH, LHL, LMH, LML, LLH and LLL). The Arithmetical Mean Deviation of the Profile (WRa) of each of the thus obtained twelve frequency components (LLL to HHH) is obtained. In this application, in order to clarify this Arithmetical Mean Deviation of the Profile from the general Arithmetical Mean Deviation of the Profile (Ra) defined in JIS B0601, the Arithmetical Mean Deviation of the Profile is referred to as WRa.

In the present application, the wavelet transformation is performed using software MATLAB. In this regard, the band width is determined depending on the software, and therefore the band width does not have special meaning. Since the WRa depends on the band width, the WRa changes if the band width is changed.

In addition, the frequency range overlaps between HML and HLH, LHL and LMH, LMH and LML, LML and LLH, and LLH and LLL. The reason therefore is as follows. Specifically, in the wavelet transformation, an original signal is decomposed to L (Low-pass Components) and H (high-pass Components) in the first wavelet transformation (Level 1), and then the L is subjected to the wavelet transformation to decompose the L to LL and HL. In this regard, when the frequency component f is identical to the separation frequency F, the frequency f is the boundary in separation, and therefore the frequency is separated into the L and H. This phenomenon is unavoidable in the multi-resolution analysis. Therefore, it is preferable that the frequencies included in the original signal are properly set so that the frequency band to be observed is not separated in the wavelet transformation.

In the multi-resolution analysis, the wavelet transformation is performed twice, and the first wavelet transformation is sometimes referred to as MRA-1, and the second wavelet transformation is sometimes referred to as MRA-2. In order to distinguish between the MRA-1 and MRA-2, a prefix H (for MRA-1) or L (for MRA-2) is attached to each frequency band. Various wavelet functions such as Daubecies function, Haar function, Meyer function Symlet function and Coiflet function can be used for the mother wavelet function used for the MRA-1 and the MRA-2. In this application, the Haar function is used, but the mother wavelet function is not limited thereto.

When the multi-resolution analysis in which the data is separated into plural frequency components of from a high frequency component to a low frequency component using the wavelet transformation is performed, the number of the plural frequency components is preferably from 4 to 8, and more preferably 6.

In the multi-resolution analysis, initially the MRA-1 is performed to separate the data into plural frequency components, and then the minimum frequency component is sampled while thinned to prepare a one-dimensional data array on which the data of the minimum frequency component is reflected. The thus prepared one-dimensional data array is subjected to the MRA-2 using wavelet transformation to separate the date into plural frequency components of from a high frequency component to a low frequency component.

The thinning operation performed on the minimum frequency component obtained in the MRA-1 is characterized in that the number of data arrays is reduced to 1/10 to 1/100. In this regard, the data thinning produces an effect to increase the frequency of data (i.e., to widen the width of the logarithmic scales on the horizontal axis in the graph). For example, when the number of the arrays of the one-dimensional data array obtained in the MRA-1 is 30,000, the number of arrays is reduced to 3,000 if a 1/10 thinning process is performed. In this regard, if the thinning rate of the thinning process is less than 10 (for example, a 1/5 thinning processing is performed), the data frequency increasing effect is small. In this case, even when the MRA-2 using wavelet transformation is performed, the data cannot be well separated.

In contrast, if the thinning rate of the thinning process is greater than 100, the data frequency excessively increases.

In this case, even when the MRA-2 using wavelet transformation is performed, the data cannot be well separated because of being concentrated to the high frequency component. The method of thinning data is that if a 1/100 thinning processing is performed, 100 data are averaged and the average is used as a representative of the 100 data.

Figure 4:
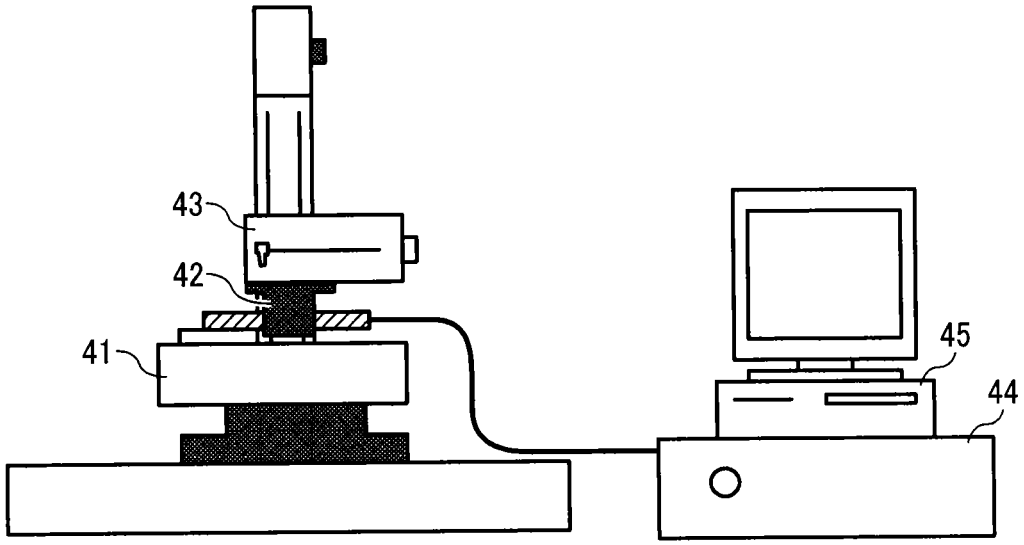
FIG. 4 is a schematic view illustrating a surface roughness and profile measuring system.

FIG. 4 is a schematic view illustrating a surface roughness and profile measuring system. Referring to FIG. 4, numeral 41 denotes a photoconductor to be measured, numeral 42 denotes a jig to which a surface roughness measuring probe is attached, numeral 43 denotes a mechanism to move the jig 42 along the surface of the sample, numeral 44 denote a surface roughness and profile measuring instrument, and numeral 45 denotes a personal computer to perform a signal analysis. In this system, the personal computer 45 performs calculations in the above-mentioned multi-resolution analysis. When the photoconductor 41 is a cylindrical photoconductor, the surface roughness of the photoconductor in any direction such as the circumferential direction and the axis direction can be measured.

The system illustrated in FIG. 4 is an example, and the surface roughness and profile measuring system is not limited thereto. For example, the device to perform the above-mentioned multi-resolution analysis is not limited to a personal computer, and for example, a numerical calculation processor can also be used. In addition, the processing may be performed by the surface roughness and profile measuring instrument itself. The method of displaying the results is not particularly limited, and the results may be shown in a CRT or a liquid crystal display. Alternatively, the results may be printed out. Further, the results may be transmitted to another device as electric signals, or may be stored in a USB (universal serial bus) memory or a MO (magnetoptic) disc.

In this application, SURFCOM 1400D from Tokyo Seimitsu Co., Ltd. is used as the surface roughness and profile measuring instrument 44, a personal computer from International Business Machine Corporation is used for the personal computer 45, and SURFCOM 1400D is connected with the personal computer using a cable RS-232-C. Processing of the data of surface roughness sent from SURFCOM 1400D to the personal computer and calculation in the multi-resolution analysis are performed using software prepared by the present inventors using C language.

Next, the procedure of the multi-resolution analysis of the profile of a surface of a photoconductor will be described by reference to a specific example. The profile of a photoconductor was obtained using an instrument, SURFCOM 1400D from Tokyo Seimitsu Co., Ltd. The measurement length in the first measurement was 12 mm, and the number of sampling points was 30720. In one measurement, profiles of four portions of the surface of the photoconductor were obtained. The profile data were sent to a personal computer, and then subjected to a first wavelet transformation (MRA-1) using a program prepared by the present inventors. The minimum frequency component obtained in the MRA-1 was subjected to a 1/40 thinning processing, followed by a second wavelet transformation (MRA-2).

Next, the Arithmetical Mean Deviation of the Profile (WRa), the maximum height (Rmax) and the ten-point mean roughness (Rz) of each of the frequency components obtained in the first and second multi-resolution analyses were determined. An example of the result is shown in FIG. 5.

Figure 5:
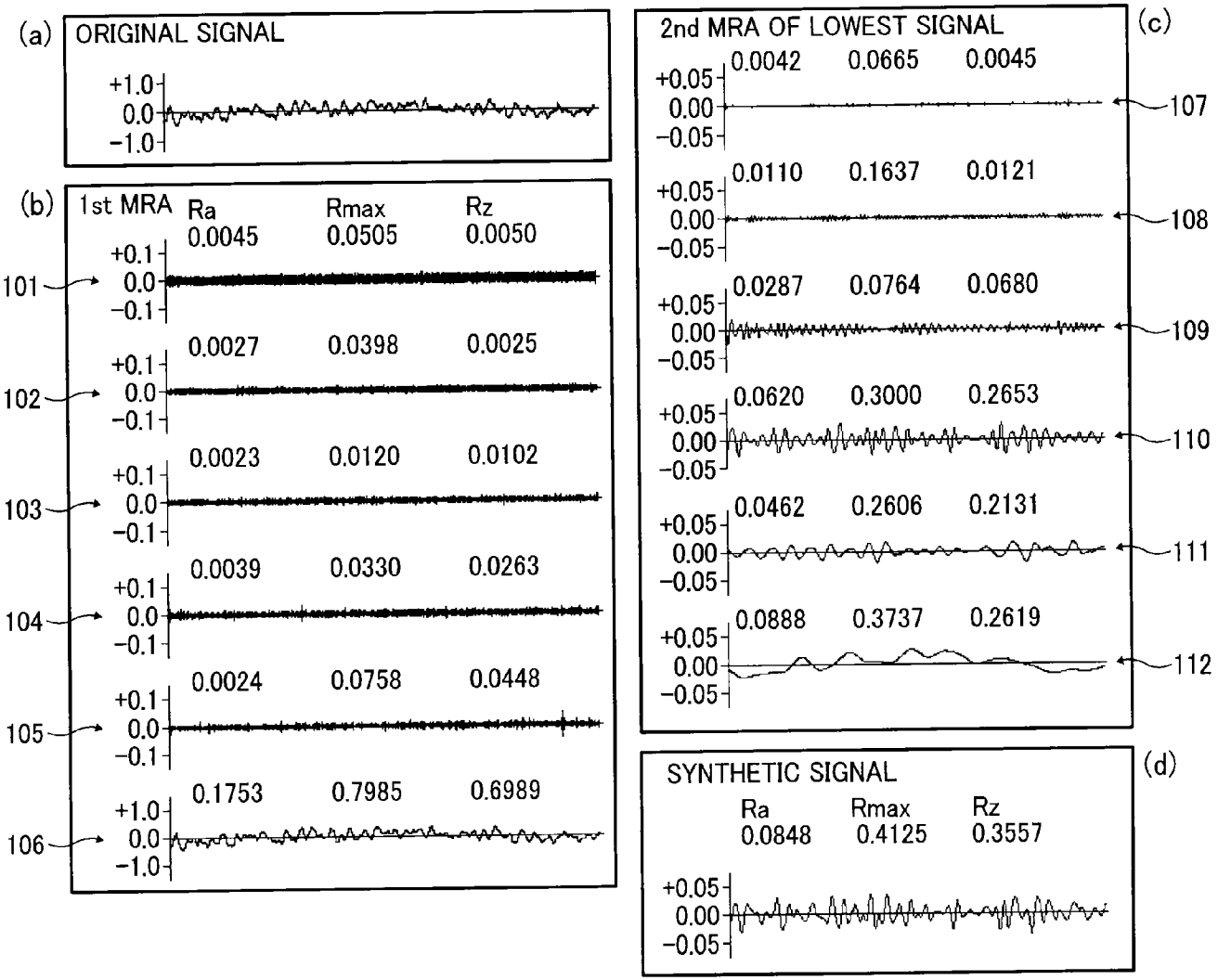
FIG. 5 is a diagram illustrating an example of the result of the first and second multi-resolution analyses.

FIG. 5(*a*) illustrates original data obtained by the instrument, SURFCOM 1400D. The data is sometimes referred to as a roughness curve or a profile curve.

FIG. 5 includes 14 graphs, in which the displacement (in units of μm) is plotted on the vertical axis, and the length (measurement length) is plotted on the horizontal axis. Although the scale is not illustrated on the horizontal axis, the measurement length is 12 mm. In conventional surface roughness measurements, the Arithmetical Mean Deviation of the Profile (Ra), the maximum height (Rmax) and the ten-point mean roughness (Rz) of the sample are obtained from the roughness curve illustrated in FIG. 5(*a*).

The six graphs in FIG. 5(*b*) illustrate the results of the MRA-1. In FIG. 5(*b*), the uppermost graph is a graph of the maximum frequency component (HHH), and the lowermost graph is a graph of the minimum frequency component (HLL).

In FIG. 5(*b*), numeral 101 denotes a graph of the maximum frequency component (HHH) in the MRA-1. Numeral 102 denotes a graph of a frequency component (HHL) one rank lower than the HHH in the MRA-1. Numeral 103 denotes a graph of a frequency component (HMH) two ranks lower than the HHH in the MRA-1. Numeral 104 denotes a graph of a frequency component (HML) three ranks lower than the HHH in the MRA-1. Numeral 105 denotes a graph of a frequency component (HLH) four ranks lower than the HHH in the MRA-1. Numeral 106 denotes a graph of a minimum frequency component (HLL) in the MRA-1.

In this analysis, the graph illustrated in FIG. 5(*a*) is separated into six graphs illustrated in FIG. 5(*b*) based on the frequency. This frequency separation is illustrated in FIG. 6.

Figure 6:
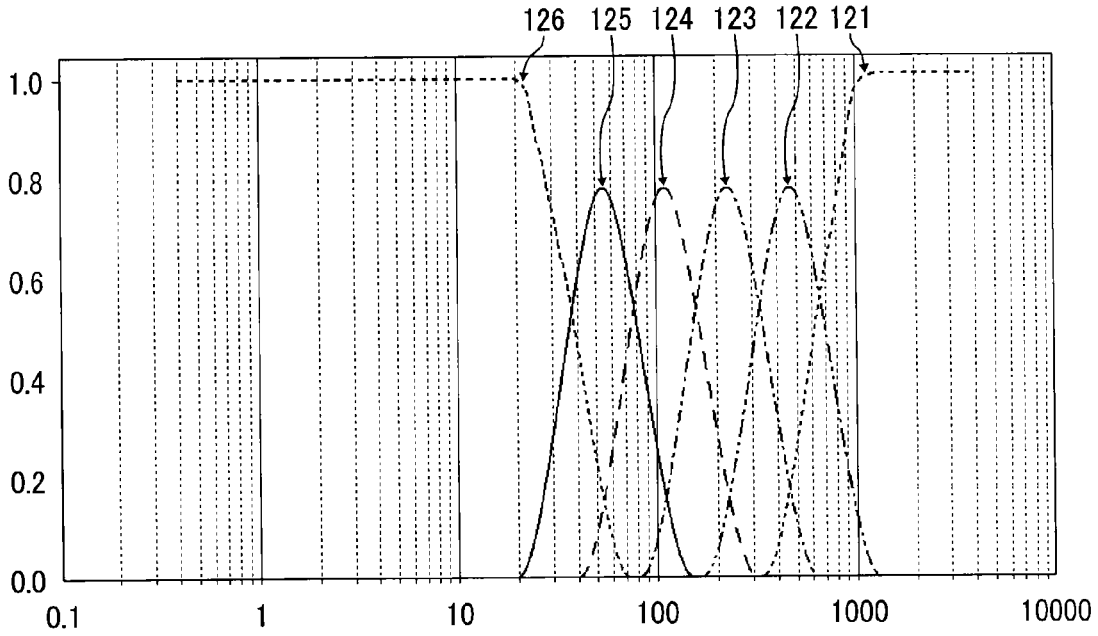
FIG. 6 is a diagram illustrating separation of the bandwidth of the frequency by multi-resolution analysis for the first time.

In FIG. 6, the number of convexities and concavities in a length of 1 mm is plotted on the horizontal axis, wherein it is assumed that the shape of the convexities and concavities is sine-wave. In addition, the proportion is plotted on the vertical axis when the band separation is performed.

In FIG. 6, numeral 121 denotes the band of the HHH in the MRA-1, numeral 122 denotes the band of the HHL in the MRA-1, numeral 123 denotes the band of the HMH in the MRA-1, numeral 124 denotes the band of the HML in the MRA-1, numeral 125 denotes the band of the HLH in the MRA-1, and numeral 126 denotes the band of the HLL in the MRA-1.

FIG. 6 will be described in detail. When the number of convexities and concavities per 1 mm is not greater than 20, all the data of convexities and concavities appear in the graph 126. When the number of convexities and concavities per 1 mm is 110, the data of convexities and concavities appear in the graph 124 most strongly, and appear in the HML 104 in FIG. 5(*b*). When the number of convexities and concavities per 1 mm is 220, the data of convexities and concavities appear in the graph 123 most strongly, and appear in the HMH 103 in FIG. 5(*b*). When the number of convexities and concavities per 1 mm is 310, the data of convexities and concavities appear in both the graphs 122 and 123, and appear in both the HHL 102 and HMH 103 in FIG. 5(*b*). Thus, depending on the frequency of the surface roughness, the data appears in any one or more of the six graphs. In other words, data of fine roughness appears on an upper graph in FIG. 5(*b*), and data of large roughness (swell) appears on a lower graph in FIG. 5(*b*).

As mentioned above, the surface roughness data is decomposed based on the frequency thereof, and the decomposed data is illustrated as graphs in FIG. 5(*b*). In each graph, the surface roughness is obtained to determine the surface roughness in the band. In this regard, the Arithmetical Mean Deviation of the Profile, the maximum height and the ten-point mean roughness can be determined as the surface roughness as illustrated in FIG. 5(*b*).

In FIG. 5(*b*), the Arithmetical Mean Deviation of the Profile (WRa), the maximum height (WRmax) and the ten-point mean roughness (WRz) are illustrated in each graph. In this regard, since the properties are obtained as a result of wavelet transformation, W (wavelet transformation) is attached thereto as a prefix.

In this analysis, the measurement data obtained by the surface roughness and profile measuring instrument is separated into plural data based on the frequency. Therefore, change of convexities and concavities in each frequency band can be measured.

In addition, among the separated data illustrated in FIG. 5(*b*), the data of the minimum frequency component (HLL) is thinned.

The thinning rate (i.e., the number of extracted data) is determined by experiment. By properly setting the thinning rate, the frequency band separation can be properly performed in the multi-resolution analysis illustrated in FIG. 6. Namely, it becomes possible that the targeted frequency is included in the center of a band.

Figure 7:
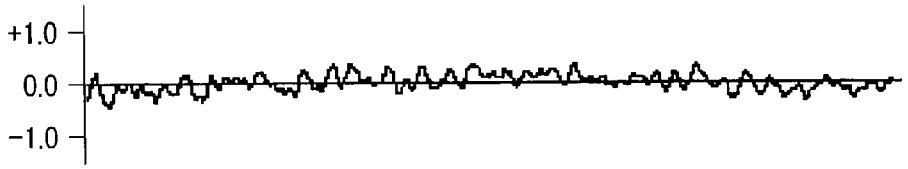
FIG. 7 is a graph of the lowest frequency data in multi-resolution analysis for the first time.

In FIG. 5, a thinning proceeding in which one data is extracted from 40 data was performed. The results of the thinning proceeding are shown in FIG. 7. In FIG. 7, the surface roughness (in units of μm) is plotted on the vertical axis, and the length is plotted on the horizontal axis. Although the scale is not illustrated, the measurement length is 12 mm.

The data illustrated in FIG. 7 is further subjected to a multi-resolution analysis, i.e., a second multi-resolution analysis MRA-2.

FIG. 5(*c*) illustrates six graphs obtained from the MRA-2.

In FIG. 5(*c*), an uppermost graph 107 illustrates the maximum frequency component LHH in the MRA-2. A graph 108 illustrates a frequency component LHL one rank lower than the LHH in the MRA-2. A graph 109 illustrates a frequency component LMH two ranks lower than the LHH in the MRA-2. A graph 110 illustrates a frequency component LML three ranks lower than the LHH in the MRA-2. A graph 111 illustrates a frequency component LLH four ranks lower than the LHH in the MRA-2. A graph 112 illustrates a minimum frequency component LLL in the MRA-2.

In this analysis, the data is separated into six graphs illustrated in FIG. 5(*c*) based on the frequency. This frequency separation is illustrated in FIG. 8.

Figure 8:
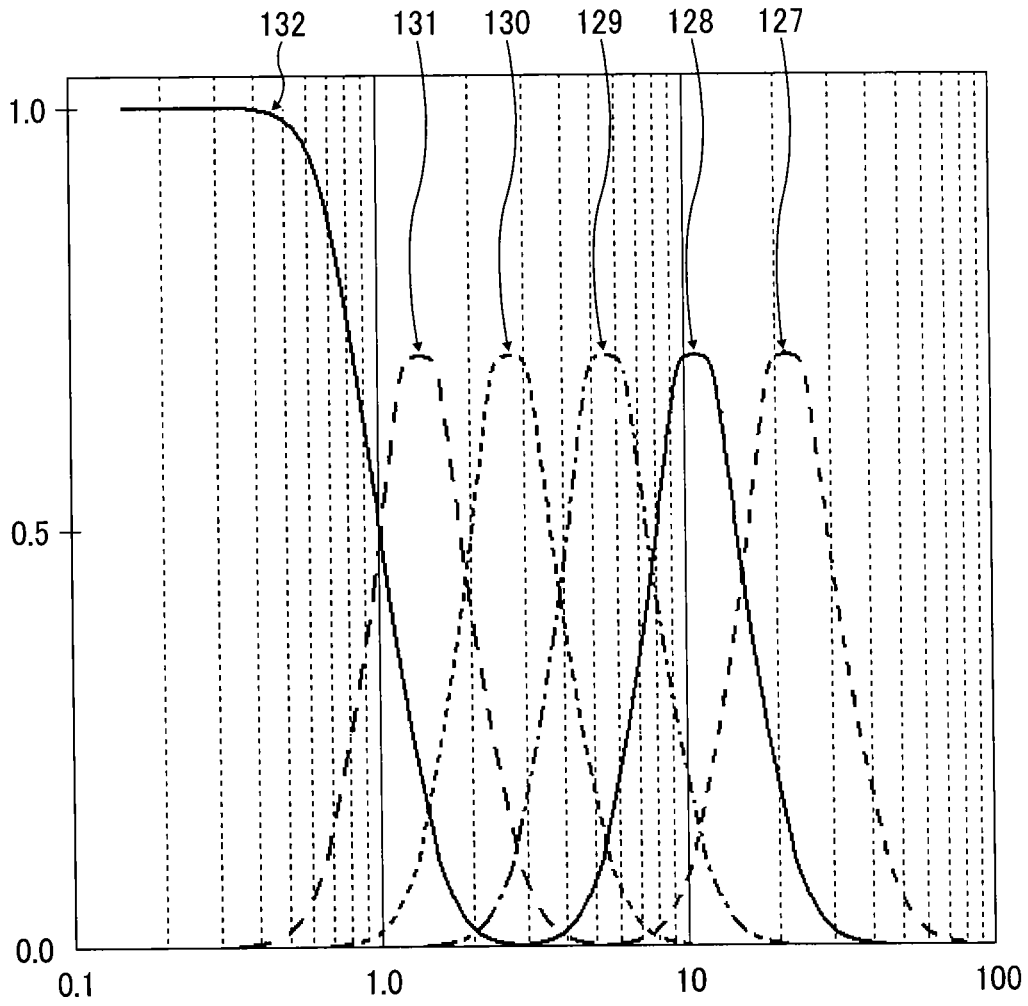
FIG. 8 is a diagram illustrating separation of the bandwidth of the frequency by multi-resolution analysis for the second time.

In FIG. 8, the number of convexities and concavities in a length of 1 mm is plotted on the horizontal axis, wherein it is assumed that the shape of the convexities and concavities is sine-wave. In addition, the proportion of each band is plotted on the vertical axis.

In FIG. 8, numeral 127 denotes the band of the LHH in the MRA-2, numeral 128 denotes the band of the LHL in the MRA-2, numeral 129 denotes the band of the LMH in the MRA-2, numeral 130 denotes the band of the LML in the MRA-2, numeral 131 denotes the band of the LLH in the MRA-2, and numeral 132 denotes the band of the LLL in the MRA-2.

FIG. 8 will be described in detail. When the number of convexities and concavities per 1 mm is not greater than 0.2, all the data of the convexities and concavities appear in the graph 132.

When the number of convexities and concavities per 1 mm is 11, the graph 128 is the highest at the number. This means that the data of the convexities and concavities appear in the LLH band most strongly in FIG. 5(*c*). Thus, depending on the frequency of the surface roughness, the data appears in any one or more of the six graphs.

In other words, data of fine roughness appears on an upper graph in FIG. 5(*c*), and data of large roughness (swell) appears on a lower graph in FIG. 5(*c*).

As mentioned above, the surface roughness data is decomposed based on the frequency thereof, and the decomposed data is illustrated as graphs in FIG. 5(*c*). In each graph, the surface roughness is obtained to determine the surface roughness in the band. In this regard, the Arithmetical Mean Deviation of the Profile (WRa), the maximum height (WRmax) and the ten-point mean roughness (WRz) can be determined as the surface roughness as illustrated in FIG. 5(*c*).

Thus, the one-dimensional data array obtained by measuring the roughness of surface of a photoconductor using a surface roughness and profile measuring instrument is subjected to a multi-resolution analysis using the wavelet transformation to separate the data into plural frequency components of from a high frequency component to a low frequency component. In addition, the minimum frequency component is thinned to prepare a one-dimensional data array, and the one-dimensional data array is subjected to a second multi-resolution analysis using the wavelet transformation to separate the data into plural frequency components of from a high frequency component to a low frequency component. The Arithmetical Mean Deviation of the Profile (WRa), the maximum height (WRmax) and the ten-point mean roughness (WRz) of each frequency component are obtained. The results are shown in Table 1 below.

TABLE 1

| | | Surface roughness determined from the multi-resolution analysis | | |
|---|---|---|---|---|
| Multi-resolution analysis | Signal | WRa (μm) | WRmax (μm) | WRz (μm) |
| First multi-resolution analysis (MRA-1) | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| Second multi-resolution analysis (MRA-2) | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

Figure 9:
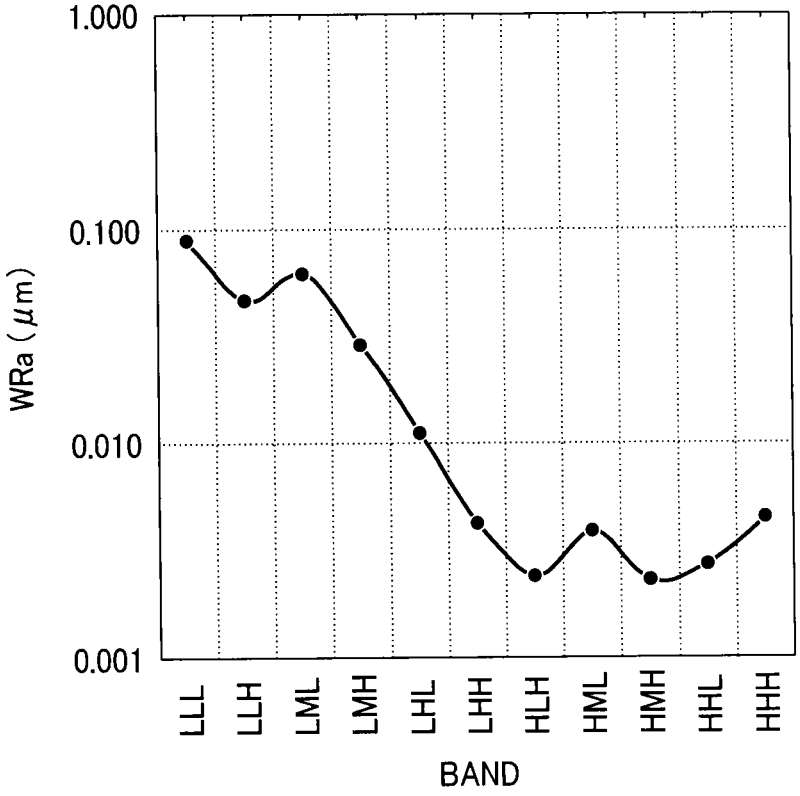
FIG. 9 is a diagram illustrating a profile of a curve obtained by plotting the arithmetic mean roughness (WRa) of each signal determined from the result of the multi-resolution analysis of the cross-sectional curve in FIG. 5.

By plotting the data of the Arithmetical Mean Deviation of the Profile (WRa) of the profile illustrated in FIG. 5 while connecting the data with a line, a curve (profile) illustrated in FIG. 9 is obtained. In this regard, since the WRa of the HLL is numerically prominent, the value is not plotted in FIG. 9. Since the HLL component is subjected to the MRA-2 and the components of from LHH to LLL are formed thereby, omission of the HLL causes no problem. In this application, the profile illustrated in FIG. 9 is referred to as a surface roughness spectrum or a roughness spectrum.

The surface profile of the intermediate layer alone may be directly measured, and when a photosensitive layer is layered thereon, after the photosensitive layer is peeled off therefrom and the intermediate layer is washed when necessary to measure the surface profile thereof Next, the image forming method and the image forming apparatus of the present invention are explained in detail.

The imaging forming method is named an electrophotographic method and the imaging forming apparatus is named an electrophotographic apparatus.

The imaging method of the present invention a charging process charging a photoconductor, an irradiating process writing an electrostatic latent image on the surface of the charged photoconductor, a developing process developing the electrostatic latent image with a toner to from a toner image, a transferring process transferring the toner image onto a transfer material, a fixing process fixing the toner image thereon, and other processes when necessary.

The imaging forming method of the present invention can be executed by the image forming apparatus of this invention. The imaging forming apparatus of the present invention includes a photoconductor bearing a latent image, a charger charging the surface of the photoconductor, an irradiator writing an electrostatic latent image on the surface of the charged photoconductor, an image developer developing the electrostatic latent image with a toner to from a toner image, a transferer transferring the toner image onto a transfer material, a fixer process fixing the toner image thereon, and other means when necessary.

Figure 10:
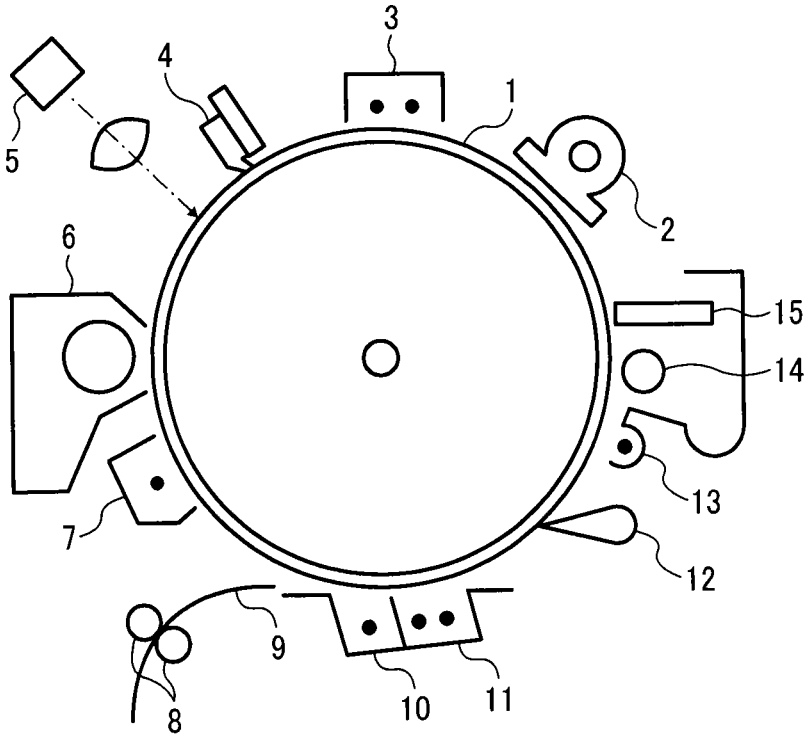
FIG. 10 is a schematic view for explaining the electrophotographic image forming method and the electrophotographic image forming apparatus of the present invention.

FIG. 10 is a schematic view for explaining the electrophotographic method and apparatus of the present invention, and a modified embodiment as mentioned below belongs to the present invention. In FIG. 10, a photoconductor 1 is drum-shaped, and may be sheet-shaped or endless-belt shaped. Any known chargers such as a corotron, a scorotron, a solid state charger and a charging roller can be used for a charger 3, a pre-transfer charger 7, a transfer charger 10, a separation charger 11 and a pre-cleaning charger 13.

The above-mentioned chargers can be used as transfer means, and typically a combination of the transfer charger and the separation charger is effectively used.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL) and the like. In addition, in order to obtain light having a desired wave length range, filters such as sharp-cut filters, band pass filters, near-infrared cutting filters, dichroic filters, interference filters, color temperature converting filters and the like can be used. The above-mentioned light sources can be used for not only the processes mentioned above and illustrated in FIG. 10, but also other processes, such as a transfer process, a discharging process, a cleaning process, a pre-exposure process, which include light irradiation to the photoconductor.

When a toner image formed on the photoconductor 1 by a developing unit 6 is transferred onto a transfer sheet 9, all of the toner image are not transferred thereon, and residual toner particles remain on the surface of the photoconductor 1. The residual toner is removed from the photoconductor by a fur blush 14 and a blade 15. The residual toner remaining on the photoconductor 1 can be removed by only a cleaning brush. Suitable cleaning blushes include known cleaning blushes such as fur blushes and mag-fur blushes.

When the photoconductor which is previously charged positively is exposed to imagewise light, an electrostatic latent image having a positive or negative charge is formed on the photoconductor. When the latent image having a positive charge is developed with a toner having a negative charge, a positive image can be obtained. In contrast, when the latent image having a positive charge is developed with a toner having a positive charge, a negative image can be obtained. As the developing method, known developing methods can be used. In addition, as the discharging methods, known discharging methods can be also used.

The electrophotographic image forming process is not limited to the process of the image forming apparatus illustrated in FIG. 10. The above-mentioned image forming devices may be fixedly set to the image forming apparatus (such as copiers, facsimiles and printers), but can be set to the image forming apparatus as a unit, i.e., a process cartridge. The process cartridge includes a photoconductor, and at least one of a charger, an irradiator, an image developer, a transferer, a cleaner and a discharger. Various process cartridges can be used, and an example of the process cartridge used in imagio MF200 from Ricoh Company, Ltd. is illustrated in FIG. 11. FIG. 11 is a schematic view illustrating an electrophotographic image forming apparatus using the electrophotographic process cartridge of the present invention.

A charger 102 charges a photoconductor 101, an irradiator 103 irradiates the photoconductor 101 to form an electrostatic latent image on the photoconductor 101. An image developer 104 develops the latent image with a toner, a transferer 106 transfers the toner image onto a transfer material 105, and which passes a fixer 109 to be a hardcopy. A cleaning blade 107 cleans the surface of the photoconductor 101, and a discharge lamp 108 discharges the photoconductor 101. The receiving paper 105, the image transfer device 106, the discharge lamp 108 and the fixer 109 are not included in the process cartridge.

As irradiating processes, an imagewise light exposure and a discharge exposure are illustrated, the photoconductor can be irradiated with other known irradiating processes such as a pre-transfer exposure and an exposure before the imagewise light exposure.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

The below-mentioned intermediate layer coating liquid was applied on an aluminum drum having a thickness of 3 mm, a length of 970 mm and a diameter of 80 mm, followed by drying to form an intermediate layer with a thickness of 5 μm. Next, the below-mentioned charge generation layer coating liquid was applied on the intermediate layer, followed by drying to form a charge generation layer with a thickness of 1 μm. Further, the below-mentioned charge transport layer coating liquid was applied on the charge generation layer, followed by drying to form a charge transport layer with a thickness of 30 μm.

Example 1

A mixture including the following materials was dispersed by a ball mill for 72 hrs to prepare an intermediate layer coating liquid.

(Intermediate Layer)

| | |
|---|---|
| Metal oxide $T_1$ (Purity: 99.7%; Rutilated Rate: 99.1%; and Average Primary Particle Diameter: 0.25 μm) | 120 |
| Metal oxide $T_2$ (Purity: 99.8%; Anatase Type; and Average Primary Particle Diameter: 0.25 μm) | 30 |
| Alkyd Resin (BECKOLITE M6401-50 including a solid content of 50% from DIC Corp.) | 84 |
| Melamine resin solution (SUPER BECKAMIN G-821-60 including a solid content of 60% from DIC Corp.) | 47 |
| Methyl Ethyl Ketone | 1,330 |
| Cyclohexanone | 570 |

The intermediate layer coating liquid was sprayed on the aluminum drum having a length of 970 mm and a diameter of 80 mm, followed by drying at 150° C. for 30 min to form an intermediate layer having a thickness of 5 μm.

(Charge Generation Layer)

| | |
|---|---|
| Asymmetric Disazo Pigment having the following formula (Y) | 10 |

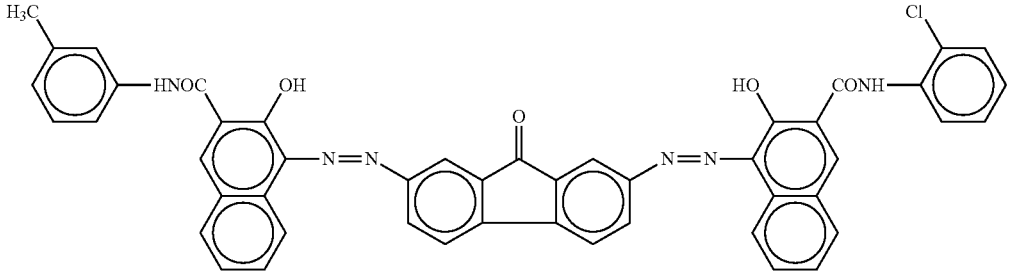

(Y)

| | |
|---|---|
| Metal-Free Phthalocyanine Pigment | 5 |
| Polyvinylbutyral (Butvar-B90) | 3 |
| Cyclohexanone | 150 |

A mill base having the above composition was dispersed by a ball mill for 72 hrs.

After dispersion, 250 parts by weight of cyclohexanone and 1,200 parts by weight of 2-butanone were added to the dispersion, followed by dispersing for 3 hrs to prepare the charge generation coating liquid.

The charge generation coating liquid was coated on the intermediate layer to form the charge generation layer having a thickness of 1 μm thereon.

(Charge Transport Layer)

| | |
|---|---|
| A compound having the following formula (X) | 7 |

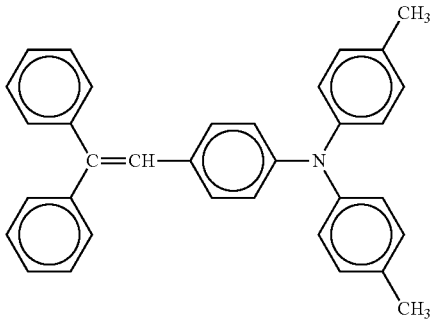

(X)

| | |
|---|---|
| Polycarbonate Resin (TS-2040 from Teijin Chemicals Ltd.) | 11 |

-continued

| | |
|---|---|
| Silicone Oil (KF-50 from Shin-Etsu Chemical Co., Ltd.) | 0.002 |
| Antioxidant (Sumilizer TPS from Sumitomo Chemical Co., Ltd.) | 0.08 |
| Compound having the following formula (Z) | 0.5 |

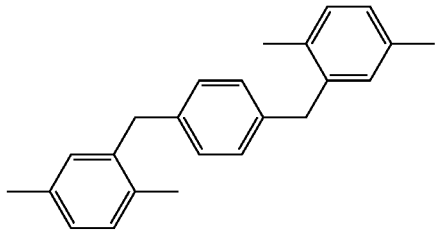

(Z)

| | |
|---|---|
| Tetrahydrofuran | 90 |
| Cyclohexanone | 160 |

These were dissolved to prepare a charge transport layer coating liquid.

The charge transport layer coating liquid was coated on the charge generation layer, and dried at 155° C. for 60 min to form a charge transport layer having an average thickness of 30 μm thereon. Thus, a photoconductor was prepared.

Example 2

The procedure for preparation of the photoconductor in Example 1 was repeated except for changing the amounts of the solvents in the intermediate layer as follows.

| | |
|---|---|
| Methyl Ethyl Ketone | 1,620 |
| Cyclohexanone | 280 |

Comparative Example 1

The procedure for preparation of the photoconductor in Example 1 was repeated except for changing the amounts of the solvents in the intermediate layer as follows.

| | |
|---|---|
| Methyl Ethyl Ketone | 1,720 |
| Cyclohexanone | 180 |

Example 3

The procedure for preparation of the photoconductor in Example 1 was repeated except for changing the metal oxide ($T_2$) as follows.

| | |
|---|---|
| Metal oxide $T_2$ (Purity: 99.99%; Rutilated Rate: 90.1%; and Average Primary Particle Diameter 0.13 μm) | 30 |

Example 4

The procedure for preparation of the photoconductor in Example 1 was repeated except for changing the metal oxide ($T_2$) as follows.

| | |
|---|---|
| Metal oxide $T_2$ (Purity: 99.99%; Rutilated Rate: 46.1%; and Average Primary Particle Diameter 0.07 μm) | 30 |

Example 5

The procedure for preparation of the photoconductor in Example 1 was repeated except for changing the metal oxide ($T_1$) and the metal oxide ($T_2$) as follows.

| | |
|---|---|
| Metal oxide $T_1$ (Purity: 99.1%; Rutilated Rate: 99%; and Average Primary Particle Diameter 0.25 μm) | 85 |
| Metal oxide $T_2$ (Purity: 99.99%; Rutilated Rate: 46.1%; and Average Primary Particle Diameter 0.07 μm) | 65 |

Example 6

The procedure for preparation of the photoconductor in Example 1 was repeated except for changing the metal oxide ($T_1$) and the metal oxide ($T_2$) as follows.

| | |
|---|---|
| Metal oxide $T_1$ (Purity: 99.1%; Rutilated Rate: 100%; and Average Primary Particle Diameter 0.25 μm) | 130 |
| Metal oxide $T_2$ Purity: 99.8%; Anatase Rate: 80%; and Average Primary Particle Diameter 0.036 μm) | 20 |

Example 7

The procedure for preparation of the photoconductor in Example 4 was repeated except that the intermediate layer had a thickness of 3.5 μm.

Example 8

The procedure for preparation of the photoconductor in Example 4 was repeated except that the intermediate layer had a thickness of 4 μm.

Example 9

The procedure for preparation of the photoconductor in Example 4 was repeated except that the intermediate layer had a thickness of 7 μm.

Example 10

The procedure for preparation of the photoconductor in Example 4 was repeated except that the intermediate layer had a thickness of 10 μm.

Example 11

The procedure for preparation of the photoconductor in Example 4 was repeated except that two spray guns instead of one spray gun were used to form the charge transport layer to shorten the drying time accompanied with double coating, and WRa (LLH) was adjusted from 0.1 to 0.05 μm.

Example 12

The procedure for preparation of the photoconductor in Example 4 was repeated except for lengthening the drying time accompanied with double coating to form the charge transport layer and adjusting WRa (LLH) from 0.1 to 0.2 μm.

Example 13

The procedure for preparation of the photoconductor in Example 4 was repeated except for lengthening the drying time accompanied with double coating to form the charge transport layer and adjusting WRa (LLH) from 0.1 to 0.3 μm.

Comparative Example 2

The procedure for preparation of the photoconductor in Example 4 was repeated except for changing the amounts of the solvents in the intermediate layer as follows.

| | |
|---|---|
| Methyl Ethyl Ketone | 570 |
| Cyclohexanone | 1,330 |

Comparative Example 3

The procedure for preparation of the photoconductor in Example 4 was repeated except for changing the amounts of the solvents in the intermediate layer as follows.

| | |
|---|---|
| Methyl Ethyl Ketone | 1,900 |

The photoconductors of Examples 1 to 5 and Comparative Examples 1 and 2 and image forming apparatuses using them were evaluated with respect to the following properties (1) and (2). The evaluation results were shown in Table 2.

(1) The surface profile of each of the photoconductors was measured under the following conditions.

Instrument used: Surface roughness and profile measuring instrument, SURFCOM 1400D from Tokyo Seimitsu Co., Ltd.

Pickup used: E-DT-S02A

Measurement length: 12 mm

Total number of sampling points: 30,720

Measurement speed: 0.06 mm/s

Random one point of the photosensitive layer in the circumferential direction at every 194 mm from the end of the drum was measured right after the photoconductor was prepared. After the after-mentioned durability test, random one point of the photosensitive layer in the circumferential direction at every 194 mm from the end of the drum was cut in the form of a rectangle having a size of 20 mm×20 mm to reveal the intermediate layer, and the surface profile of which was measured. The charge generation layer adhering to the intermediate layer was wiped off with methanol. There was no particular difference of the profile curve of the intermediate layer between a case where the layer was directly measured right after coated and a case where a photosensitive layer was peeled off after coated on the intermediate layer.

The one-dimensional data array of the profile of the surface of the photoconductor was subjected to a first multi-resolution analysis (MRA-1) using wavelet transformation to be separated into six frequency components of from HHH to HLL. Further, the one-dimensional data array of the HLL was thinned so that the number of the data array was reduced to 1/40, and the thinned one-dimensional data array was subjected to a second multi-resolution analysis (MRA-2) using wavelet transformation to be separated into six frequency components of from LHH to LLL. The Arithmetical Mean Deviation of the Profile (WRa) of each of the thus obtained twelve frequency components of from HHH to LLL was obtained. This surface profile measurement was performed on four portions of the surface of the photoconductor, which portions are apart at regular intervals of 70 mm. The Arithmetical Mean Deviation of the Profile (WRa) of each of the twelve frequency components of from HHH to LLL in each portion was obtained.

The average of the four data of the Arithmetical Mean Deviation of the Profile (WRa) of each of the twelve frequency components was obtained to determine the Arithmetical Mean Deviation of the Profile (WRa) of the frequency component.

(2) Each of the photoconductors was installed in imagio MP W7140 from Ricoh Company, Ltd., and a text image pattern having an image density of 6% was continuously produced in an environment of 25° C. and 55% RH. The photoconductor was controlled to have a charge potential of −800 V with a grid bias of the charger when starting the test. The image was printed on the whole surface of My Paper A1 having a size of 841 mm×200 m. Genuine toner and developer were used. Background fouling was classified to 5 grades, and the image was produced until a level that the background fouling is not accepted in the market. Background fouling durability was evaluated by a mileage of the photoconductor during which the test was performable.

(3) Content of Cyclohexanone in Photoconductor

A pieces of the photoconductor together with the aluminum substrate in an appropriate size was cut out to be a sample. The layer film was weighed by deducting a weight of the aluminum substrate from a weight of the sample. Cyclohexanone included in the photoconductor was measured by GCMS method using QP-2010 from Shimadzu Corp. (Column: Ultra ALLOY-5 L: 30 m I. D: 0.25 mm Film: 0.25 μm).

TABLE 6

| | Mileage (km) | Intermediate Layer WRa (LLH) (μm) | Intermediate Layer WRa (LHH) (μm) | Titanium Oxide (*) Average Primary Particle Diameter (μm) | Titanium oxide $T_2$ Average Primary Particle Diameter (μm) |
|---|---|---|---|---|---|
| Example 1 | 40 | 0.045 | 0.05 | 0.303 | 0.25 |
| Example 2 | 40 | 0.11 | 0.18 | 0.303 | 0.25 |
| Comparative Example 1 | 10 | 0.15 | 0.24 | 0.303 | 0.25 |
| Example 3 | 50 | 0.045 | 0.06 | 0.226 | 0.13 |
| Example 4 | 60 | 0.038 | 0.05 | 0.214 | 0.07 |
| Example 5 | 40 | 0.034 | 0.05 | 0.172 | 0.07 |
| Example 6 | 30 | 0.037 | 0.05 | 0.221 | 0.036 |
| Example 7 | 20 | 0.036 | 0.05 | 0.214 | 0.07 |
| Example 8 | 50 | 0.036 | 0.05 | 0.214 | 0.07 |
| Example 9 | 40 | 0.036 | 0.05 | 0.214 | 0.07 |
| Example 10 | 20 | 0.036 | 0.05 | 0.214 | 0.07 |
| Example 11 | 30 | 0.036 | 0.05 | 0.214 | 0.07 |
| Example 12 | 55 | 0.036 | 0.05 | 0.214 | 0.07 |
| Example 13 | 30 | 0.036 | 0.05 | 0.214 | 0.07 |
| Comparative Example 2 | 10 | 0.020 | 0.02 | 0.214 | 0.07 |
| Comparative Example 3 | 10 | 0.20 | 0.28 | 0.214 | 0.07 |

| | Rutilated Rate of Titanium Oxide (%) | Thickness of Intermediate Layer (μm) | Photosensitive Layer WRa (LLH) (μm) | Content of Cyclohexanone in Photoconductor (ppm) |
|---|---|---|---|---|
| Example 1 | 99.1 | 5 | 0.10 | 12 |
| Example 2 | 99.1 | 5 | 0.10 | 12 |
| Comparative Example 1 | 99.1 | 5 | 0.10 | 12 |
| Example 3 | 90.1 | 5 | 0.11 | 12 |
| Example 4 | 46.7 | 5 | 0.10 | 12 |
| Example 5 | 46.7 | 5 | 0.10 | 12 |
| Example 6 | 99.1 | 5 | 0.10 | 12 |
| Example 7 | 46.7 | 3.5 | 0.11 | 10 |
| Example 8 | 46.7 | 4 | 0.11 | 11 |
| Example 9 | 46.7 | 7 | 0.11 | 14 |
| Example 10 | 46.7 | 10 | 0.11 | 20 |

TABLE 6-continued

| | | | | |
|---|---|---|---|---|
| Example 11 | 46.7 | 5 | 0.05 | 10 |
| Example 12 | 46.7 | 5 | 0.20 | 10 |
| Example 13 | 46.7 | 5 | 0.30 | 10 |
| Comparative Example 2 | 46.7 | 5 | 0.11 | 500 |
| Comparative Example 3 | 46.7 | 5 | 0.11 | 0 |

(*) the addition average value of $T_1$ and $T_2$.

Table 2 proves each of the photoconductors including an intermediate layer having a WRa (LLH) less than 0.12 μm and WRa (LHH) of from 0.03 to 0.2 μm of present invention has no background fouling and good durability, i.e., mileage is not less than 20 km. Particularly, the intermediate layer including two titanium oxides having high purity and average primary particle diameters different from each other makes the photoconductor have good properties producing no abnormal images such as black spots. Further, the titanium oxide having a rutilated rate of from 30 to 60% further prevents production of abnormal images such as black spots. In addition, the image forming apparatus using the photoconductor of the present invention has good properties as well.

Each of Comparative Examples 1 to 3 which does not satisfy the requirement of including an intermediate layer having a WRa (LLH) less than 0.12 μm and WRa (LHH) of from 0.03 to 0.2 μm has background fouling and poor durability, i.e., mileage is 10 km.

Namely, the photoconductor of the present invention stably produces high-quality images even when repeatedly used for long periods, preventing production of abnormal images such as uneven image density and background fouling. The photoconductor can meet speeding up, downsizing, colorization, higher image quality and easy maintenance strongly desired for image forming apparatuses such as copiers, laser printers and plain paper facsimile and image forming method.

Having now fully described the invention, it will be apparent to one of ordinary skill in the art that many changes and modifications can be made thereto without departing from the spirit and scope of the invention as set forth therein.

What is claimed is:

1. A photoconductor, comprising:

an electroconductive substrate;

an intermediate layer; and a photosensitive layer, wherein the intermediate layer is formed by spray coating and comprises a metal oxide and a binder resin, and has a WRa (LLH) less than 0.12 μm and WRa (LHH) of from 0.03 to 0.2 μm in a curve obtained by:

(I) forming one-dimensional data array by measuring a concave-convex form of the surface of the intermediate layer by a surface roughness and profile measurer;

(II) subjecting the one-dimensional data array to wavelet transformation by a multi-resolution analysis (MRA-1) to separate the data array into six frequency components through the highest frequency component HHH, the second frequency component HHL, the third frequency component HMH, the fourth frequency component HML the fifth frequency component HLH to the lowest frequency component HLL;

(III) thinning the one-dimensional data array of the lowest frequency component HLL so that a number of data array is reduced to 1/10 to 1/100 to prepare a thinned one-dimensional data array;

(IV) subjecting the thinned one-dimensional data array to wavelet transformation by a multi-resolution analysis (MRA-2) to separate the data array into six frequency components through the highest frequency component LHH, the second frequency component LHL, the third frequency component LMH, the fourth frequency component LML, the fifth frequency component LLH to the lowest frequency component LLL; and (V) linking logarithms of eleven arithmetic mean roughnesses of from WRa (LLL) to WRa (HHH) excluding WRa (HLL) of the frequency components obtained in (II) and (IV), wherein the arithmetic mean roughnesses (Ra) of the frequency components are defined in JIS-B0601:2001 as follows:

WRa (HHH): Ra in a bandwidth having a cycle length of convexoconcave of from 0 to 3 μm, WRa (HHL): Ra a bandwidth having a cycle length of convexoconcave of from 1 to 6 μm, WRa (HMH): Ra a bandwidth having a cycle length of convexoconcave of from 2 to 13 μm, WRa (HML): Ra a bandwidth having a cycle length of convexoconcave of from 4 to 25 μm, WRa (HLH):Ra in a bandwidth having a cycle length of convexoconcave of from 10 to 50 μm, WRa (HLL): Ra in a bandwidth having a cycle length of convexoconcave of from 24 μm to 99 μm, WRa (LHH): Ra in a bandwidth having a cycle length of convexoconcave of from 26 to 106 μm, WRa (LHL): Ra in a bandwidth having a cycle length of convexoconcave of from 53 to 183 μm, WRa (LMH): Ra in a bandwidth having a cycle length of convexoconcave of from 106 to 318 μm, WRa (LML): Ra in a bandwidth having a cycle length of convexoconcave of from 214 to 551 μm, WRa (LLH): Ra in a bandwidth having a cycle length of convexoconcave of from 431 to 954 μm, and WRa (LLL): Ra in a bandwidth having a cycle length of convexoconcave of from 867 to 1,654 μm, wherein the metal oxide is a titanium oxide, wherein the metal oxide is a mixture comprising two metal oxides $T_1$ and $T_2$ each having an average primary particle diameter different from each other, and wherein one of the metal oxides $T_2$ has an average primary particle diameter ($D_2$) larger than 0.05 μm and smaller than 0.10 μm, wherein the titanium oxide comprises a rutile titanium oxide and an anatase titanium oxide, and wherein the photosensitive layer includes a metal-free phthalocyanine and an azo pigment as a charge generation material.

2. The photoconductor of claim 1, wherein the metal oxide has an average primary particle diameter of from 0.18 to 0.22 μm.

3. The photoconductor of claim 1, wherein the metal oxide comprises metal oxides having a rutilated rate of from 30 to 60%.

4. The photoconductor of claim 1, wherein the intermediate layer has a thickness of from 4 to 7 μm.

5. The photoconductor of claim 1, wherein the photosensitive layer has an arithmetic mean roughness WRa (LLH) of from 0.07 to 0.2 μm when subjected to the multi-resolution analyses MRA-1 and MRA-2.

6. The photoconductor of claim 1, further comprising cyclohexanone in an amount of from 10 to 100 ppm.

7. An image forming method, comprising:

charging the surface of the photoconductor according to claim 1;

irradiating the surface of the photoconductor with imagewise light to form an electrostatic latent image thereon;

developing the electrostatic latent image with a toner to form a toner image on the photoconductor;

transferring the toner image onto a transfer material; and fixing the toner image on the transfer material.

8. An image forming apparatus, comprising:

a charger configured to charge the surface of the photoconductor according to claim 1;

an irradiator configured to irradiate the surface of the photoconductor with imagewise light to form an electrostatic latent image thereon;

an image developer configured to develop the electrostatic latent image with a toner to form a toner image on the photoconductor;

a transferer configured to transfer the toner image onto a transfer material; and a fixer configured to fix the toner image on the transfer material.

9. The photoconductor of claim 1, wherein the intermediate layer includes cyclohexanone.

* * * * *